US009976203B2

(12) United States Patent
Jun et al.

(10) Patent No.: US 9,976,203 B2
(45) Date of Patent: May 22, 2018

(54) ULTRA FINE-GRAINED ADVANCED HIGH STRENGTH STEEL SHEET HAVING SUPERIOR FORMABILITY

(71) Applicant: ArcelorMittal, Luxembourg (LU)

(72) Inventors: Hyun Jo Jun, Valparaiso, IN (US); Narayan Subramaniam Pottore, Munster, IN (US); Nina Michailovna Fonstein, Chicago, IL (US); Oleg N. Yakubovsky, Munster, IN (US)

(73) Assignee: ArcelorMittal, Luxembourg (LU)

( * ) Notice: Subject to any disclaimer, the term of this patent is extended or adjusted under 35 U.S.C. 154(b) by 768 days.

(21) Appl. No.: 13/747,451

(22) Filed: Jan. 22, 2013

(65) Prior Publication Data

US 2014/0205488 A1 Jul. 24, 2014
US 2017/0114433 A9 Apr. 27, 2017

Related U.S. Application Data

(60) Provisional application No. 61/588,393, filed on Jan. 19, 2012.

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/08*** | (2006.01) |
| ***C22C 38/00*** | (2006.01) |

(52) U.S. Cl.

CPC ..... *C22C 38/14* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01)

(58) Field of Classification Search

None

See application file for complete search history.

(56) References Cited

U.S. PATENT DOCUMENTS

2014/0050941 A1* 2/2014 Kawasaki et al. ..... 428/653

FOREIGN PATENT DOCUMENTS

JP 2005-325388 * 11/2005
KR 10-2010-0057196 A * 5/2010

(Continued)

OTHER PUBLICATIONS

Machine-English translation of JP2005-325388, Ishida Kiyohito et al., Nov. 24, 2005.*

(Continued)

*Primary Examiner* — Deborah Yee

(74) *Attorney, Agent, or Firm* — Davidson, Davidson & Kappel, LLC

(57) ABSTRACT

A cold rolled, annealed TRIP steel sheet which has a composition including (in wt. %): C: 0.1-0.3; Mn: 4-10, Al: 0.05-5, Si: 0.05-5; and Nb: 0.008-0.1, the remainder being iron and inevitable residuals. The cold rolled sheet has an ultimate tensile strength of at least 1000 MPa, and a total elongation of at least 15%. The cold rolled sheet may have at least 20% retained austenite in its microstructure and may have greater than 50% lath-type annealed ferrite structure. The cold rolled sheet may have an ultra fine grain size of less than 5 micron for the retained austenite and ferrite.

17 Claims, 1 Drawing Sheet

(56) References Cited

FOREIGN PATENT DOCUMENTS

KR 10-2011-0012367 A * 2/2011
WO WO2012/147898 A1 * 11/2012

OTHER PUBLICATIONS

Machine-English translation of KR 10-2010-0057196A, Dong-U Seo et al., May 31, 2010.*
Machine-English translation of KR 10-2011-0012367A, Hui-Jae Gang, Feb. 9, 2011.*

* cited by examiner

ULTRA FINE-GRAINED ADVANCED HIGH STRENGTH STEEL SHEET HAVING SUPERIOR FORMABILITY

CROSS-REFERENCE TO RELATED APPLICATIONS

This Application claims the benefit under 35 U.S.C. 119(e) of U.S. Provisional Application No. 61/588,393 filed Jan. 19, 2012.

FIELD OF THE INVENTION

The present invention relates generally to Advanced High Strength Steels (AHSS). More specifically the present invention relates to (transformation induced plasticity) TRIP steel having a medium manganese content ranging between 4-10 wt. %. Most specifically the present invention relates to medium manganese bearing TRIP steels with high strength and good total elongation providing superior formability.

BACKGROUND OF THE INVENTION

As the use of high strength steels increases in automotive applications, there is a growing demand for steels of increased strength without sacrificing formability. Growing demands for weight saving and safety requirement motivate intensive elaborations of new concepts of automotive steels that can achieve higher ductility simultaneously with higher strength in comparison with the existing Advanced High Strength Steels (AHSS). The first group ("generation") of AHSS includes low alloyed DP (Dual Phase), TRIP (Transformation Induced Plasticity), CP (Complex Phase) and martensitic steels. Steels with TRIP effect demonstrate advantageous balance of strength and ductility, but commercial TRIP grades are limited mostly by tensile strength of 800 MPa. The "second generation" of AHSS is represented by highly alloyed (up to ~17-22 wt. % Mn) and extremely ductile TWIP (TWinning Induced Plasticity) steels having up to 50% elongation at 1000 MPa tensile strength, although they have not found commercial application yet.

Thus, there is a need in the art for 3rd generation AHSS, which are less alloyed than TWIP steels and have intermediate properties, such as a combination of 1000-1200 MPa strength and 20-30% elongation.

SUMMARY OF THE INVENTION

A unique combination of mechanical properties has been found in steels containing 4~10% Mn after long term (batch) annealing in the inter-critical temperature range. This is mostly attributed to Transformation Induced Plasticity (TRIP) related to the significant amount of retained austenite that was stabilized by high Mn content due to Mn partitioning between ferrite and austenite.

The inventors have found that a superior combination of strength and ductility in such steels can be obtained after short time annealing and a significant amount of austenite was retained regardless of cooling rate without any isothermal holding in the bainite region. The stability of austenite appears to be a result of a combination of fine grain size, and high Mn/carbon content in the austenite at specific inter-critical temperature. Therefore the control of grain size and Mn/C partitioning during annealing is a key process which helps to achieve superior properties in the inventive steels.

The invention is a cold rolled, annealed TRIP steel sheet. The a cold rolled steel sheet has a composition including (in wt. %): C: 0.1-0.3; Mn: 4-10, Al: 0.05-5, Si: 0.05-5; and Nb: 0.008-0.1, the remainder being iron and inevitable residuals. The cold rolled sheet has an ultimate tensile strength of at least 1000 MPa, and a total elongation of at least 15%. The composition may preferably include 4-7 wt. % Mn, and more preferably 6-7 wt. % Mn. The composition may also include about 0.1-1.1 wt. % Si, and may include about 0.5-1.6 wt % Al. The composition may include about 0.02 wt. % Nb. The composition may further include about 0.15-0.17 wt % C. The cold rolled sheet may have an ultimate tensile strength of at least 1180 MPa and may also have a total elongation of at least 20%. The cold rolled sheet may have at least 20% retained austenite in its microstructure and may have greater than 50% lath-type annealed ferrite structure. The cold rolled sheet may have an ultra fine grain size of less than 5 micron for the retained austenite and ferrite.

The cold rolled TRIP steel sheet may be formed by the steps of: 1) forming an ingot of said composition; 2) hot rolling said ingot to form a plate; 3) hot rolling said plate to form a hot rolled sheet; 4) optionally annealing said hot rolled sheet to reduce the hardness thereof, thereby easing the cold rolling requirements; 5) cold rolling said hot rolled sheet to form a cold rolled sheet; and 6) annealing said cold rolled sheet to form the microstructure and mechanical properties of said cold rolled TRIP steel sheet.

DETAILED DESCRIPTION OF THE INVENTION

Figure 1A:
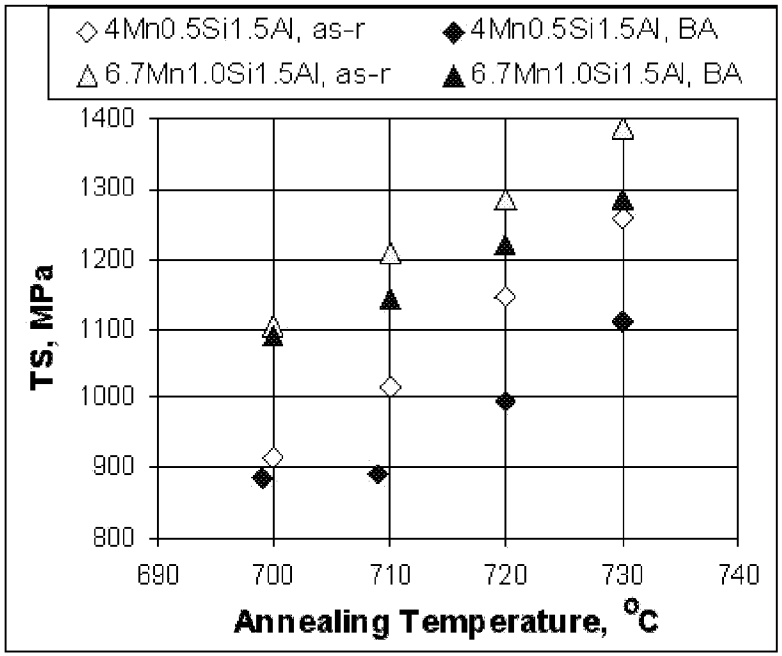
FIG. 1*a* plots the ultimate tensile strength (TS) in MPa versus cold rolled band anneal temperature in ° C.

The present invention is a family of TRIP steels. The steels have at least 20 retained austenite, greater than 50% lath-type annealed ferrite structure, and an ultra fine grain size (less than 5 micron) of the retained austenite and ferrite. The inventive steels have a unique combination of high strength and formability. The tensile properties of the present invention preferably provide an ultimate tensile strength (UTS) at least 1000 MPa with a total elongation (TE) of at least 15%. More preferably the UTS is greater than about 1180 MPa. In another embodiment, the TE is greater than 20%.

Broadly the alloy has a composition (in wt %) including C: 0.1-0.3; Mn: 4-10, Al: 0.05-5, Si: 0.05-5; and Nb: 0.008-0.1 total, the remainder being iron and inevitable residuals. More preferably, the alloy contains 4-7 wt. % Mn, most preferably the alloy contains 6-7 wt % Mn. Preferably the alloy contains about 0.1-1.1 wt. % Si, and about 0.5-1.6 wt % Al. Preferably the alloy contains about 0.02 wt. % Nb. Preferably the alloy contains about 0.15-0.17 wt % C.

EXAMPLES 50 kg ingots of steel were produced by vacuum induction melting. The ingots were reheated to 1230° C. and hot rolled to 20 mm thick plates. The plates were then reheated to 1230° C. again for homogenization for 3 hours, followed by 3-pass secondary hot rolling to the gauge of 4 mm with finishing temperature of 900° C. Accelerated cooling to a coiling temperature (CT) of 750° C. was employed to simulate the Run-Out-Table of hot strip mills. The hot rolled sheets were held for 1 hr at 750° C., and then cooled to room temperature for coiling simulation in a furnace.

Since the as-rolled Mn steels displayed very high strength, a part of as-rolled material was subjected to batch annealing at various temperatures to soften the materials. The surface oxides and decarburized layers were mechanically removed by grinding 0.5 mm from each side. The ground as-hot rolled and batch annealed sheets were cold rolled to 1.5 mm at a cold reduction of 50%. Cold rolled sheets were annealed using a Continuous Annealing Simulator (CAS) manufactured by ULVAC (CCT-AQV). This was followed by investigation of microstructure and mechanical properties.

The annealing cycle of the CAS included heating to temperatures ranging from 650° C. to 750° C. at a heating rate of 10° C./s, soaking at annealing temperatures (AT) for 180 sec, followed by cooling to room temperature at a cooling rate of 10° C./s. The mechanical properties were evaluated using ASTM A370 samples. The microstructure was observed in SEM using 2% Nital etching. The amount of retained austenite was measured using magnetic saturation method (METIS Instruments & Equipments, MSAT-30) as well as X-ray Diffraction (PANalytical, X'Pert PRO) equipped with a spinning holder to minimize texture effect. To prepare specimens for EBSD (Electron Back Scatter Diffraction) analysis, the mechanically polished specimens were electro polished in a 8% perchloric acid+92% acetic acid solution. EBSD analysis has been performed by TSL system (EDAX, Hikari) attached to FEG-SEM (JEOL, JSM-7600F).

The chemical compositions of two alloys useful in producing the steel sheets of the present invention are given in Table 1.

TABLE 1

| ID | C | Mn | Si | Nb | Al | N* | B* | Ti + Ni + Sb |
|---|---|---|---|---|---|---|---|---|
| 4Mn | 0.16 | 4.0 | 0.5 | 0.05 | 0.055 | 87 | | |
| 6.7Mn | 0.16 | 6.7 | 1.0 | | 1.479 | 74 | 17 | ~0.1 |

*ppm

Additional alloys useful in producing the steel sheets of the present invention are given in Table 2.

TABLE 2

| | 10-VI-5 | 10-VI-6 | 10-VI-7 | 10-VI-8 | 10-VI-9 |
|---|---|---|---|---|---|
| C | 0.1637 | 0.1597 | 0.16 | 0.159 | 0.155 |
| Mn | 4.106 | 4.094 | 4.11 | 4.03 | 6.73 |
| P | 0.01 | 0.01 | 0.01 | 0.01 | 0.01 |
| S | 0.006 | 0.006 | 0.005 | 0.005 | 0.005 |
| Si | 0.106 | 0.105 | 0.11 | 0.5 | 1.03 |
| Al | 0.505 | 1.012 | 1.475 | 1.55 | 1.48 |
| Cb | 0.02 | 0.021 | 0.021 | 0.02 | |
| N | 0.0071 | 0.0079 | 0.0062 | 0.007 | 0.007 |
| Ni | | | | | 0.051 |
| Sb | | | | | 0.02 |
| Ti | | | | | 0.026 |
| B | | | | | 0.0017 |

Regarding the example compositions of Table 1, the microstructure of the as-rolled steels and its evolution after batch annealing will now be described. After hot rolling the microstructure of the example steel with 4% Mn presents a mixture of quasi-granular ferrite, martensite and bainite. After batch annealing at 550° C., tempering of martensite is evident. The tempering becomes more pronounced after batch annealing at 650° C. Since the batch annealing temperature of 650° C. is above $A_{c3}$, the martensite in as rolled material is mostly replaced by ferrite matrix containing coarse cementite.

The structure of as rolled example steel with 6.7 wt % Mn demonstrates a significantly higher proportion of martensite with bainite. The martensite is visible as a lath substructure. After batch annealing at 550° C., the martensite is tempered. However, the batch annealing process does not destroy the lath morphology of martensite and cementite precipitates along the martensite lathes.

Figure 1B:
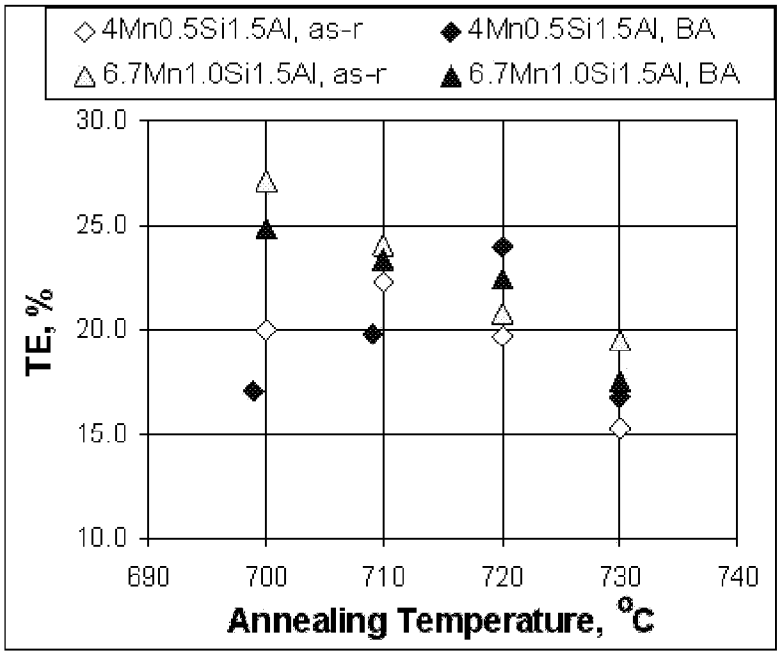
FIG. 1*b* plots the total elongation (TE) in % versus cold rolled band anneal temperature in ° C.

The hot rolled bands of the example compositions of Tablet were cold rolled at about 40-50% reduction and then annealed using Salt Pot (SP) and Continuous Annealing Simulator (CAS). SP simulation was used to simulate a CAL cycle (Annealing temperature of 680-740° C.), and CAS was used to simulate galvannealing cycle of Cleveland HDGL (AT of 700-720° C.; GAT of 505° C.). FIGS. 1*a* and 1*b* show the mechanical properties of interest for different annealing temperatures and with/without the optional batch anneal of the hot roll. Specifically, FIG. 1*a* plots the ultimate tensile strength (TS) in MPa versus cold rolled band anneal temperature in ° C. FIG. 1*b* plots the total elongation (TE) in % versus cold rolled band anneal temperature in ° C. The ◇ and ◆ symbols plot the data for the 4 wt % Mn TRIP steel cold rolled from the as rolled and batch annealed hot bands, respectively. Similarly, the ▲ and Δ symbols plot the data for the 6.7 wt % Mn TRIP steel cold rolled from the as rolled and batch annealed hot bands, respectively.

It is to be understood that the disclosure set forth herein is presented in the form of detailed embodiments described for the purpose of making a full and complete disclosure of the present invention, and that such details are not to be interpreted as limiting the true scope of this invention as set forth and defined in the appended claims.

What is claimed:

1. A cold rolled, annealed TRIP steel sheet comprising:

a cold rolled steel sheet having a composition including (in wt. %):

C: 0.1-0.3; Mn: 4-10, Al: 0.05-5, Si: 0.05-5; and Nb: 0.008-0.1, the remainder being iron and inevitable residuals;

said cold rolled sheet having an ultimate tensile strength of at least 1050 MPa, and a total elongation of at least 15%.

2. The cold rolled TRIP steel sheet of claim 1, wherein said composition includes 4-7 wt. % Mn.

3. The cold rolled TRIP steel sheet of claim 2, wherein said composition includes 6-7 wt. % Mn.

4. The cold rolled TRIP steel sheet of claim 1, wherein said composition includes from 0.1 to 1.1 wt. % Si.

5. The cold rolled TRIP steel sheet of claim 1, wherein said composition includes from 0.5 to 1.6 wt % Al.

6. The cold rolled TRIP steel sheet of claim 1, wherein said composition includes about 0.02 wt. % Nb.

7. The cold rolled TRIP steel sheet of claim 1, wherein said composition includes about 0.15-0.17 wt % C.

8. The cold rolled TRIP steel sheet of claim 1, wherein said cold rolled sheet has an ultimate tensile strength of at least 1180 MPa.

9. The cold rolled TRIP steel sheet of claim 1, wherein said cold rolled sheet has a total elongation of at least 20%.

10. The cold rolled TRIP steel sheet of claim 1, wherein said cold rolled sheet has at least 20% retained austenite.

11. The cold rolled TRIP steel sheet of claim 1, wherein said cold rolled sheet has greater than 50% lath annealed ferrite structure.

12. The cold rolled TRIP steel sheet of claim 1, wherein said cold rolled sheet has an ultra fine grain size of less than 5 micron for a retained austenite and ferrite.

13. The cold rolled TRIP steel sheet of claim 1, wherein said cold rolled sheet is formed by the steps of:

forming an ingot of said composition; hot rolling said ingot to form a plate;

hot rolling said plate to form a hot rolled sheet;

optionally annealing said hot rolled sheet to reduce the hardness thereof, thereby easing the cold rolling requirements;

cold rolling said hot rolled sheet to form a cold rolled sheet; and annealing said cold rolled sheet to form the microstructure and mechanical properties of said cold rolled TRIP steel sheet.

14. The cold rolled TRIP steel sheet of claim 1, wherein the ultimate tensile strength is at least 1080 MPa.

15. The cold rolled TRIP steel sheet of claim 1, wherein an annealing temperature is from 680 to 740° C.

16. The cold rolled TRIP steel sheet of claim 1, wherein the total elongation is 27.5% or less.

17. The cold rolled TRIP steel sheet of claim 13, wherein the step of annealing includes annealing at an annealing temperature that is from 680 to 740° C.

* * * * *